United States Patent [19]

Stevens

[11] 4,295,285

[45] Oct. 20, 1981

[54] SNOWTHROWER

[75] Inventor: Eric Stevens, El Cajon, Calif.

[73] Assignee: The Toro Company, Minneapolis, Minn.

[21] Appl. No.: 104,264

[22] Filed: Dec. 17, 1979

[51] Int. Cl.[3] ..... E01H 5/00

[52] U.S. Cl. ..... 37/43 D; 56/294

[58] Field of Search ..... 37/43 R, 43 D, 43 A, 37/43 B, 43 C, 43 E, 43 F, 43 G, 43 H, 43 K, 43 L, 53; 56/249, 13.3, 220, 294, 2, 244, 229, 251, 254, 289, DIG. 9, DIG. 17, DIG. 20; 200/42 R, 44, 52 R, 61.58 R, 61.64

[56] References Cited

U.S. PATENT DOCUMENTS

| | | | |
|---|---|---|---|
| Re. 25,810 | 6/1965 | Postlewait et al. | 56/294 X |
| 2,049,883 | 8/1936 | Worthington | 56/294 |
| 2,063,067 | 12/1936 | Waller | 56/294 X |
| 2,687,683 | 8/1954 | Chattin | 56/294 X |
| 2,714,772 | 8/1955 | Erickson | 37/43 D |
| 3,452,460 | 7/1969 | Cope et al. | 37/43 D |
| 3,596,577 | 8/1971 | Chennells | 37/43 D X |
| 3,729,143 | 4/1973 | Wagstaff et al. | 56/294 X |
| 4,062,135 | 12/1977 | Dobberpuhl | 37/43 R |
| 4,190,972 | 3/1980 | Berner | 37/43 D |

FOREIGN PATENT DOCUMENTS

| | | | |
|---|---|---|---|
| 477752 | 10/1951 | Canada | 56/249 |

*Primary Examiner*—E. H. Eickholt
*Attorney, Agent, or Firm*—James W. Miller

[57] ABSTRACT

An improved snowthrower (2) comprises a housing (4) having a rotatable impeller (6) therein. Impeller (6) is rotationally molded from plastic and is easily replaceable in housing (4). Moreover, impeller (6) includes a plurality of snow impelling blades (60) which are sufficiently rigid to transmit a drive torque from one side wall (63) to the other side wall (62) of impeller (6). Thus, impeller (6) does not require the use of a through shaft. In addition, snowthrower (2) includes a switch (93) for actuating the drive motor (8). Switch bar (96) is movable to cause switch (93) to close. However, lockout member (110) can be positioned in engagement with switch bar (96) to prevent inadvertent or accidental actuation of switch (93). Lockout member (100) is moved to a non-locking position only when a key member (116) is inserted into a control grip (112).

8 Claims, 12 Drawing Figures

SNOWTHROWER

TECHNICAL FIELD

This invention relates in general to a snowthrower or the like for clearing snow from a ground surface such as a sidewalk or driveway. More particularly, this invention relates to an electrically operated snowthrower which is also relatively light and easy to handle.

DESCRIPTION OF THE PRIOR ART

Snowfall often occurs during the winter in northern climates. This snow can accumulate on the ground in relatively large amounts. It is then necessary to clear the snow from the sidewalks and driveways of a dwelling. Such snow removal is often mandated by local municipal ordinances. More expediently, snow removal is often required simply to have easy access to one's house or to allow one's automobile to be removed from the driveway.

The traditional method of snow removal comprises manual shoveling. In this method, the propulsive force for removing the snow comes entirely from the person doing the shoveling. The disadvantages and hardships associated with this method of snow removal are well known. For example, it can be extremely tiring. Moreover, it can also be dangerous to persons having cardiac conditions because of the strain placed upon the heart.

Various types of snow removal machines, commonly referred to as snowblowers or snowthrowers, have been developed and used in place of manual snow shoveling. These devices usually include a housing having some type of snow impelling mechanism, e.g. a rotatable rotor or auger. The mechanism throws or blows the snow outwardly from the housing to a point remote from the ground area being cleared. Many of the prior art machines have been relatively heavy. Wheels or rollers have been attached to the housing to allow the machine to be rolled or steered over the ground. In fact, some of these machines were so heavy that these wheels were driven by some type of drive motor. However, machines of this type are difficult to handle and steer, especially on a slippery surface such as snow. Many people have been deterred from using them because of this difficulty. In addition, the complexity and weight of the machine increases its cost rendering it uneconomical for certain users who do not have large areas of ground to be cleared of snow. Apartment dwellers are one example of a user in this latter group.

A small electrically operated snowthrower has been developed to replace the more conventional manual shovels and the larger motorized snowblowers currently in use. This snowthrower is configured to act much like a shove and, in fact, is manipulated by the user in a manner similar to a shovel. The snowthrower has a small housing at one end of an elongated handle that extends upwardly from the housing. The housing includes a relatively open reel-type impeller and a small electric motor for rotating the impeller. A scraper bar is provided adjacent the bottom edge of the rear wall of the housing to allow the housing to bite into the snow. The rear wall of the housing also includes a guide section and an arcuate portion which conforms to the periphery of the impeller. As the impeller rotates, the blades of the impeller contact and move the snow through the housing and eventually throw the snow up along the guide section of the rear wall to a position distally located from the thrower.

The snowthrower noted immediately above is advantageous since it is directed to another segment of the snow clearing market, namely to users having smaller areas of ground to clear, who cannot or are unwilling to handle larger snowthrowers, or who cannot afford more expensive snowthrowers. However, the impeller in the snowthrower previously described includes a through shaft. This shaft extends through the entire length of the rotor and is journaled at each end in the end walls of the housing. The various elements of the impeller, such as the blades and the blade supporting means, are affixed to this through shaft for rotation therewith. However, the use of the through shaft increases both the weight of the impeller and the complexity of the device, e.g. the need for bearings in each of the end walls to receive the ends of the shaft. Moreover, it is relatively difficult to remove and replace an impeller according to this construction. Easy impeller replacement is especially important in a tool such as this which is designed to be a low cost consumer-type item. Obviously, it would be disadvantageous to replace the entire snowthrower every time the impeller might fail.

In addition, since this snowthrower is a mass produced consumer operated tool, it must be designed as safely as possible. Since the device is electrically operated, it requires only the depression of a switch to rotate the impeller. It would be advantageous to include some type of safety means to prevent inadvertent actuation of the motor and impeller. However, in keeping with the low cost nature of the snowthrower, this safety means cannot be unduly complicated or expensive.

SUMMARY OF THE INVENTION

Accordingly, this invention relates to a snowthrower of the type noted above not having the disadvantages of the previously known devices. More particularly, this invention relates to a small, lightweight, electrically operated snowthrower having a housing in which an easily replaceable impeller is mounted for rotation and which further includes safety means for preventing inadvertent actuation of the motor of the snowthrower.

The snowthrower of this invention is of the type which has a snowthrowing impeller mounted in an impeller housing. The impeller housing has end walls and an outlet through which the snow is thrown by the impeller. The impeller is mounted between the end walls of the housing for rotation about a substantially horizontal axis. The impeller includes a plurality of impeller blades which are spaced apart from one another to establish an open volume therebetween. The impeller includes spaced apart side walls between which the blades extend. The blades are sufficiently rigid to transmit a drive torque from one side wall to the other side wall. The open volume, which is radially inwardly of the blades, is completely open in that no mounting shaft extends through the impeller in a direction substantially parallel to the blades. Thus, the blades themselves, rather than a mounting shaft, transmit the drive torque applied to one of the side walls through the length of the impeller. In addition, the impeller in the snowthrower of this invention may be rotationally molded in one piece from a plastic material. Preferably, the impeller is releasably secured in the housing for easy replacement thereof.

In addition, the snowthrower of this invention further includes a switch means for selectively connecting the motor means for the snow throwing impeller to a power source. This switch means includes a switch having open and closed positions. A switch bar is movable into and out of engagement with the switch for closing or opening the switch respectively to selectively actuate the motor. Means are provided for selectively locking the switch bar in an inoperative position spaced away from the switch to prevent accidential actuation of the motor means.

BRIEF DESCRIPTION OF THE DRAWINGS

This invention will be described in more detail in the following Detailed Description, when taken in conjunction with the following drawings, in which like reference numerals refer to like elements throughout.

DETAILED DESCRIPTION

Figures 1, 2, 3, 4, 5, 12:
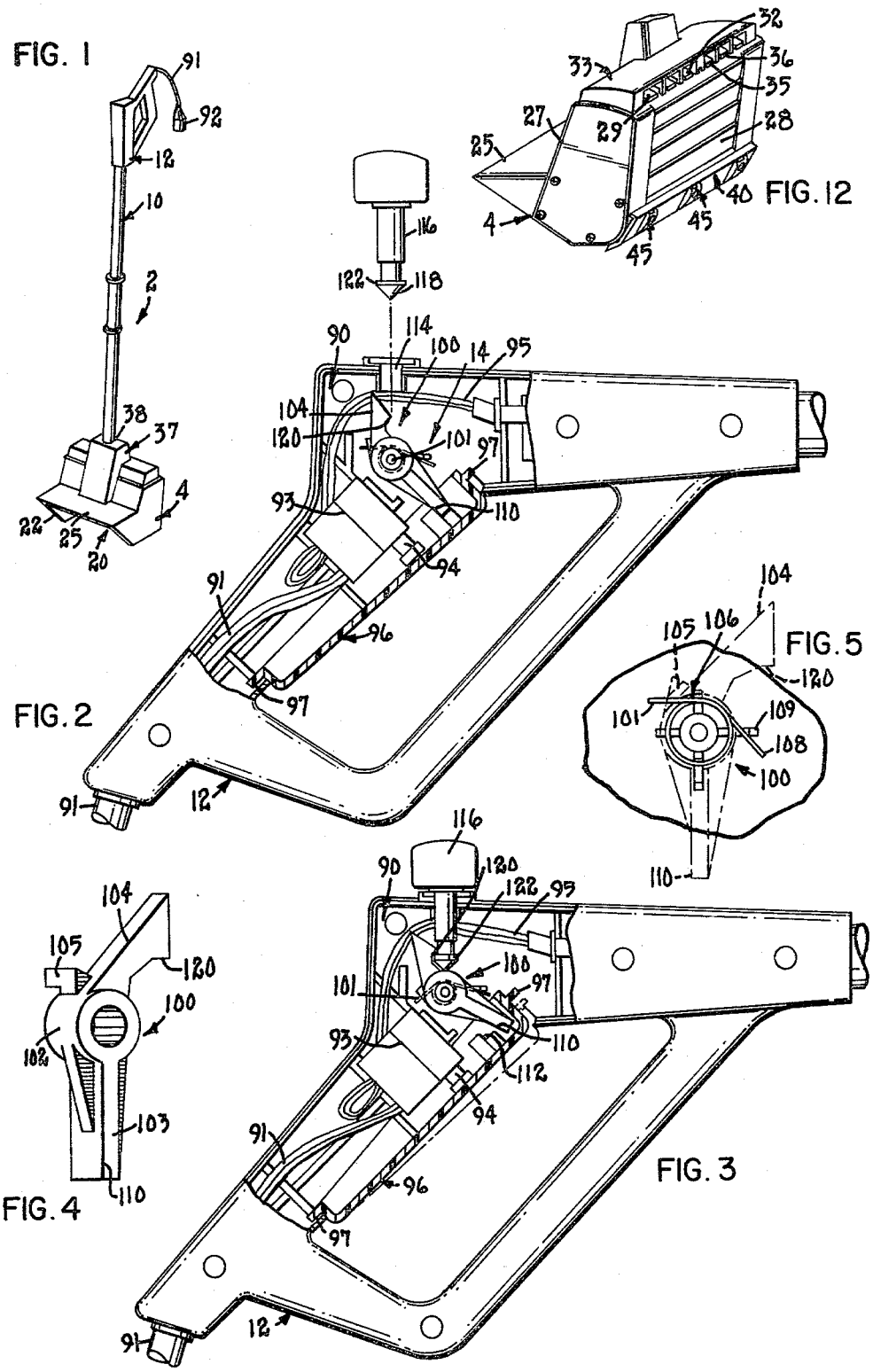
FIG. 1 is a perspective view of an improved snowthrower according to this invention.
FIG. 2 is a partial side elevational view of the control grip of the snowthrower shown in FIG. 1, with a portion thereof being broken away to particularly illustrate the switch means for actuating the motor of the snowthrower with the switch means being illustrated in a first portion in which a lockout member is in engagement with the switch bar to prevent actuation of the switch.
FIG. 3 is a partial side elevational view similar to FIG. 2, particularly illustrating the switch means in a second position in which the lockout member has been rotated to a second position to free the switch bar to allow actuation of the switch.
FIG. 4 is a perspective view of the lockout member which forms a portion of the switch means used for actuating the motor of the snowthrower shown in FIG. 1.
FIG. 5 is a partial bottom plan view of the lockout member shown in FIG. 4 as installed in the control grip of FIGS. 2 and 3, particularly illustrating a biasing spring which is operable to normally bias the lockout member to a first position thereof.
FIG. 12 is a perspective view taken from the rear of the impeller housing of the improved snowthrower of FIG. 1.
Figure 6:
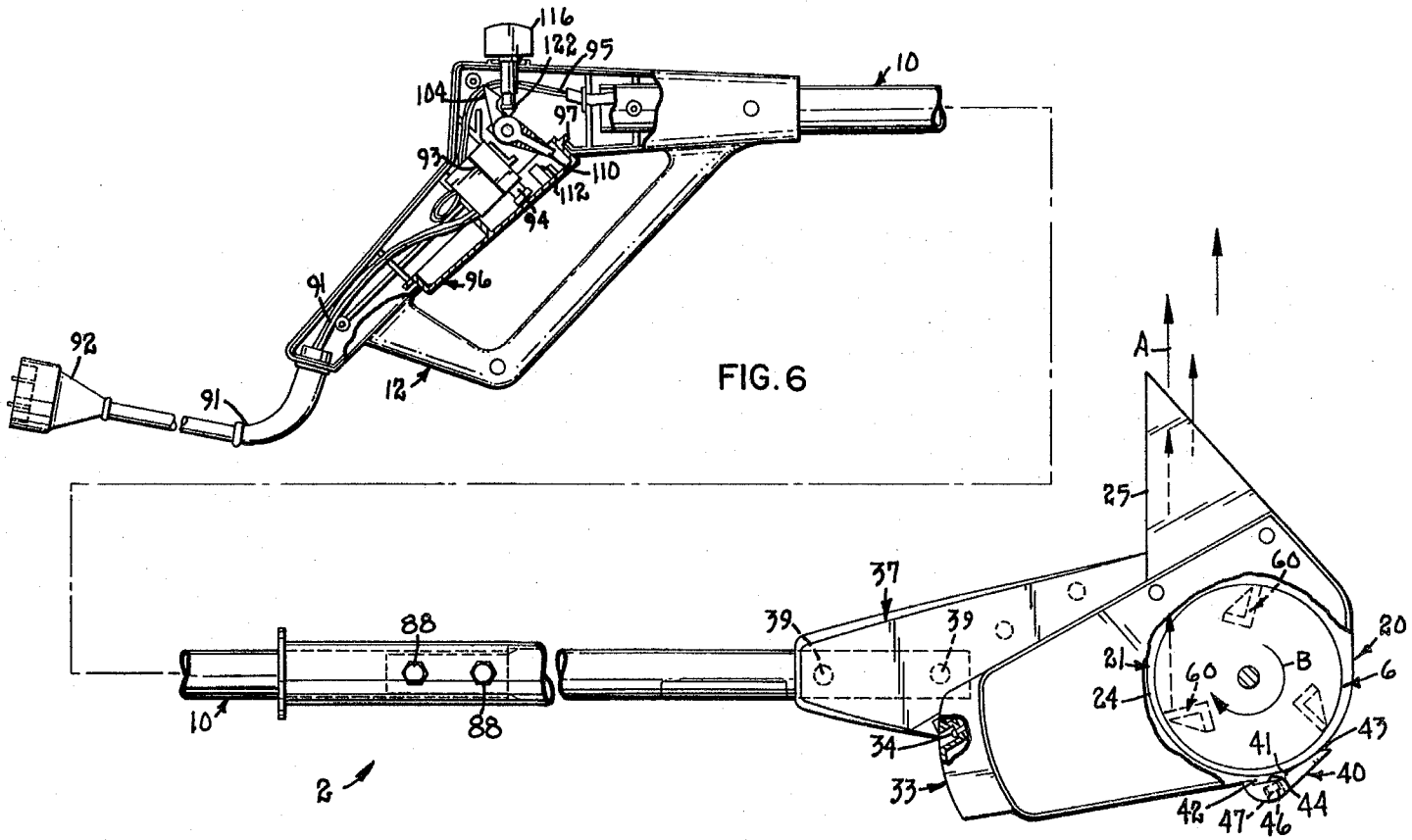
FIG. 6 is a side elevational view, with portions thereof broken away, of the improved snowthrower shown in FIG. 1.
Figures 7, 8, 9, 10, 11:
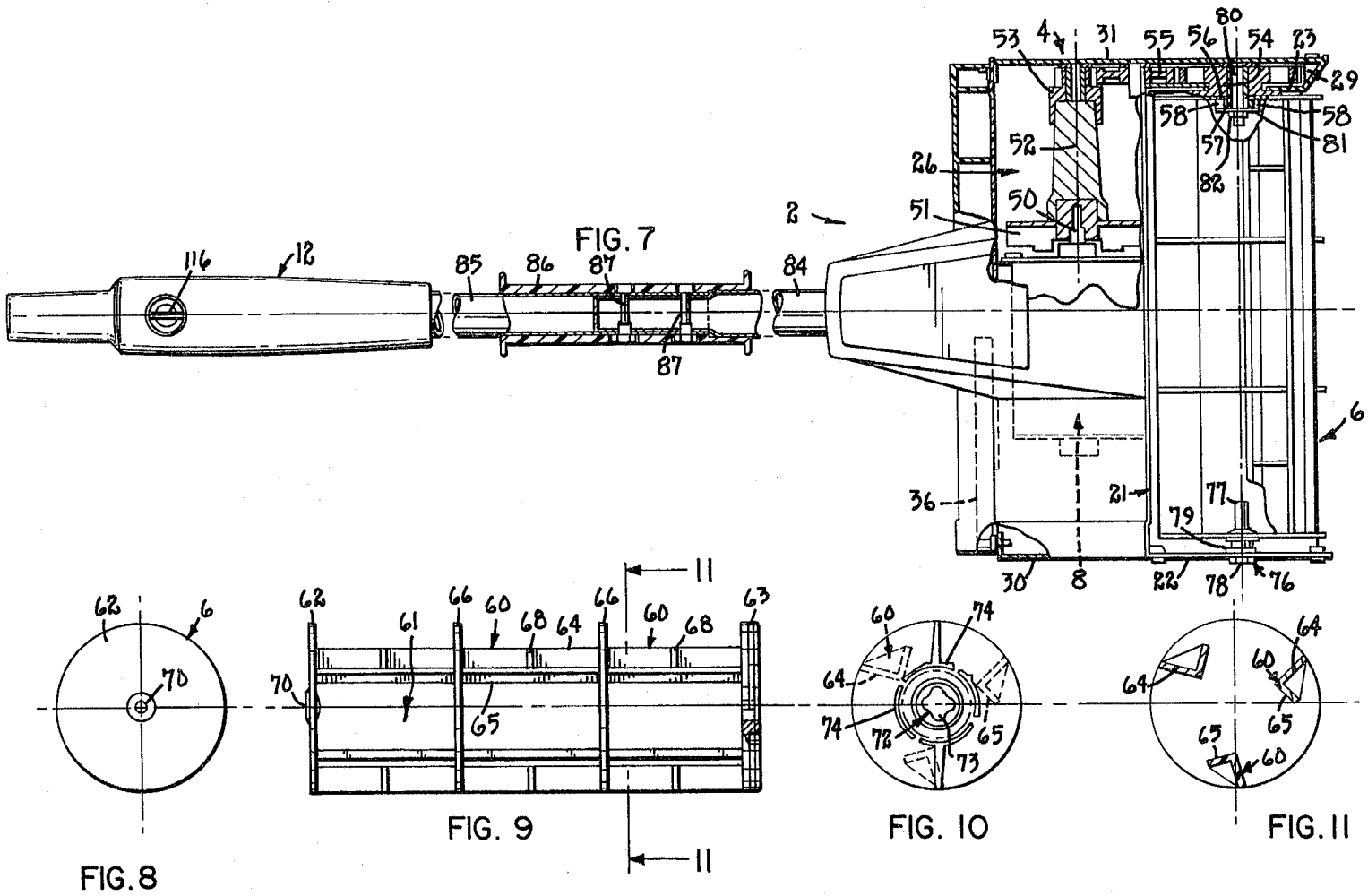
FIG. 7 is a front elevational view of the improved snowthrower shown in FIG. 1, with portions thereof being broken away and shown in cross-section.
FIG. 8 is a side elevational view of the left side of the snowthrowing impeller which is used in the snowthrower of FIG. 1.
FIG. 9 is a front elevational view of the impeller of FIG. 8.
FIG. 10 is a side elevational view of the right side of the snowthrowing impeller used in the snowthrower of FIG. 1.
FIG. 11 is a cross-sectional view of the snowthrowing impeller taken along lines 11—11 in FIG. 9.

Referring to FIGS. 1, 6 and 7, an improved snowthower according to this invention is generally illustrated as 2. By way of introduction, snowthrower 2 comprises an impeller housing 4. A rotatable snowthrowing impeller 6 is mounted for rotation inside housing 4. A drive motor 8 is mounted in housing 4 for rotating impeller 6. An elongated handle 10 extends upwardly from the top of housing 4. A control grip 12, located at the upper end of handle 10, provides a means which the user can hold while operating snowthrower 2. In addition, control grip 12 encloses a switch means 14 for controlling the actuation of drive motor 8.

THE HOUSING

Housing 4 includes an impeller containing compartment 20. Compartment 20 is defined by a rear wall 21 bounded at either side by left and right end walls 22 and 23. See FIGS. 1 and 7. Rear wall 21 includes a first arcuate portion 24 which conforms generally to the periphery of impeller 6. See FIG. 6. In addition, rear wall 21 includes a second guide portion 25 which extends forwardly from arcuate portion 24. Arcuate guide portion 24 coacts with impeller 6 to cause snow which is picked up by impeller 6 to be thrown outwardly from housing 4 along guide portion 25 as generally illustrated by the direction of arrows A. Together, rear wall 21 and the left and right end walls 22 and 23 define a compartment 20 which is generally open in a downward direction for facing a ground surface. See FIG. 1.

Housing 4 also includes a hollow and generally trapezoidal motor compartment 26 located on top of the impeller containing compartment 20. Motor compartment 26 is defined between a front wall 27, a back wall 28, and a top wall 29. Motor compartment 26 is bounded at the left side by an upper extension 30 of the left end wall 22 of compartment 20. The other side of compartment 26 is bounded by a separate side cover 31. Side cover 31 extends downwardly to cover right end wall 23. Side cover 31 is spaced from right end wall 23 to define a space 29 in which a portion of the drive means for actuating impeller 6 is contained.

Top wall 29 of compartment 26 has a plurality of slots or air passageways 32 formed therein. An air deflector member 33 is fixedly mounted, e.g. using screws 34 or the like, to top wall 29. Air deflection member 33 is open at the back as indicated at 35. Approximately one half of air deflection member 33 includes a suitable air filter 36 which covers approximately half of the slots 32. The remaining slots 32 on the other half of top wall 29 are open to the ambient air through the open rear end 35 of air deflection member 33. Slots 32 provide both air inlet and outlet passages to the motor containing compartment 32.

In addition, housing 4 includes an upwardly extending handle support member 37. Handle support member 37 is releasably attached in any suitable manner to housing 4, e.g. to motor compartment 26 and air deflection member 33. Handle support member 37 includes a circular bore 38 which receives and supports the lower end of handle 10. Preferably, handle 10 is fixedly secured to handle support member 37 by threaded securing members, such as tap screws 39 or the like, which pass in through one side of handle support member 37 and engage the lower end of handle 10.

In addition, housing 4 includes a scraper bar 40. Scraper bar 40 is releasably secured to the back wall 28 adjacent the edge 41 of the arcuate portion 24 of rear wall 21. The edge 41 of rear wall 21 coincides with the bottom edge of back wall 28. Back wall 28 includes a guide rib 42 which extends across the width thereof. Scraper bar 40 includes a knife edge 43 for biting into the snow contained on a ground surface. In addition, scraper bar 40 includes a U-shaped groove 44. Groove 44 is configured to mate with rib 42 to allow scraper bar 40 to be slid onto rib 42 by engagement of the groove on the rib. In addition, the outside surface of scraper bar 40, i.e. that surface which would contact the ground when the snowthrower 2 is laid down, includes a plurality of raised surfaces 45. Each surface 45 includes a circular opening or bore 46. Openings 46 are recessed so that they can receive and protect threaded securing members 47, such as tap screws, which are used to releasably secure scraper bar 40 to guide rib 42. Thus, the securing members 47 cannot be damaged even if the snowthrower should be laid down such that scraper bar 40 engages the ground surface.

THE DRIVE MOTOR

Drive motor 8 is fixedly contained in any suitable manner inside motor compartment 26. Preferably, drive motor 8 is fixedly supported on top of rear wall 21 which forms the bottom of motor compartment 26. Drive motor 8 is preferably a small lightweight electric motor. Although an electric motor 8 is preferred, any suitable drive motor could be used in its place.

Drive motor 8 includes a horizontal drive shaft 50. A fan 51 is mounted on drive shaft 50. When drive shaft 50 rotates during operation of motor 8, fan 51 will also be rotated. The fan rotation induces a flow of cooling air through motor compartment 26. This cooling air flow will enter motor compartment 26 through the open rear end of air deflection member 33 and down through the air filter 36 and the slots 32 covered by filter 36. The cooling air flow will exit motor compartment 26 through those slots 32 not covered by filter 36 and out through the open rear end of air deflection member 33.

In addition, means are provided for coupling drive shaft 50 to impeller 6 contained inside compartment 20. This coupling means includes a drive coupler 52 connected at one end to shaft 50 and at the other end to a pinion assembly 53. Pinion assembly 53 is connected to an impeller gear assembly 54 by an idler gear assembly 55. Both the idler gear assembly 55 and impeller gear assembly 54 are rotatably journaled on side cover 31. The impeller gear assembly 54 includes a drive hub 56 which defines a splined drive member 57. Splined drive member 57 is meant to refer to a conventional drive member having a plurality of lugs or ribs on the outside surface of a cylindrical hub. These lugs or ribs are suited for engaging in corresponding notches or grooves on the drive member which in this case is impeller 6. While the arrangement of gear assemblies 53, 54, and 55 as disclosed herein is preferred for coupling shaft 50 to impeller 6, any other suitable coupling means could also be used, e.g. belts, chains, or the like.

THE IMPELLER

Referring now particularly to FIGS. 6–11, impeller 6 comprises a plurality of snow impelling blades 60. Blades 60 are fixedly secured between spaced apart side walls 62 and 63. Impeller 6 is a reel type impeller meaning that blades 60 are circumferentially spaced apart from one another. In addition, blades 60 are spaced radially above the axis of impeller 6 to establish a substantially open radial volume 61 therebetween.

Each blade 60 includes a first working surface 64 which is generally radially oriented. More specifically, working surface 64 of blade 60 is angularly swept back with regard to a radial line extending from the axis of impeller 6 to the periphery thereof. The angle of sweep back is generally denoted as $\alpha$ in FIG. 6. The amount of this angle can vary; both the purpose and the amount of sweep back are more particularly set forth in a copending U.S. patent application relating to snowthrower 2, Ser. No. 906,637, filed May 16, 1978, which copending application is also assigned to the assignee of this invention.

In addition, each blade 60 includes a second strengthening surface 65. Strengthening surface 65 is oriented at right angles to the working surface 64 and is integrally formed thereof. Together, surfaces 64 and 65 define a generally L-shaped blade 60. In addition, a plurality of blade support members 66, e.g. solid disks, are parallel to and spaced between the side walls 62 and 63. Blade support members 66 are used to further rigidify and strengthen blade 60 by securing them together and reinforcing them against deformation. Furthermore, each blade 60 includes at least one strengthening rib 68. Rib 68 extends between the surfaces 64 and 65 of blade 60. At least one strengthening rib 60 is provided for each section of the impeller, i.e. between each of the blade support members 66 and/or side walls 62 and 63.

Side wall 62 of the impeller includes a circular opening or bore 70. The other side wall 63 of impeller 6 includes a drive aperture 72. Aperture 72 is shaped to receive the splined drive member 57 which is part of the impeller gear assembly 54. Specifically, aperture 72 is provided with four notches 73. The drive lugs on the splined drive member extend into each of the four notches 73 to rotate impeller 6 upon rotation of the drive member 57. Furthermore, side wall 63 of impeller 60 includes a plurality of arcuate sections 74. These sections 74 surround and protect the hub 56 of the impeller gear assembly 54. However, the main driving connection between the impeller gear assembly 54 and impeller 6 is the engagement of the lugs on the splined member 57 in the notches 73 of drive aperture 72.

Impeller 6 is releasably contained in compartment 20. Specifically, a stub shaft 76 is releasably affixed to end wall 22 of housing 4. Stub shaft 76 includes a longitudinal shaft 77 and an enlarged head 78. That portion of shaft 77 adjacent head 78 is exteriorly threaded such that it can receive a locknut 79. Locknut 79 is meant to be located on the inside of end wall 22 with the head 78 being in engagement with the outside of end wall 22. When the threaded portion of shaft 77 is tightened into locknut 79, head 78 will be firmly drawn into engagement with end wall 22 in order to affix stub shaft 76 thereto. The shaft 77 is suited to extend inwardly through the bore 70 of impeller 6.

Impeller gear assembly 54 is rotatably journaled on a stub shaft 80 which is fixed to side cover 31 and which extends inwardly through drive aperture 72. Stub shaft 80 rotatably journals the impeller gear assembly 54 thereon. The outer end of stub shaft 80 is threaded to receive a washer 81 and locknut 82 thereon. Washer 81 and locknut 82 will prevent axial movement of impeller 6 relative to stub shaft 80 and splined drive member 57 when locknut 82 is tightened on shaft 80 and washer 81 is forced against the inner face of the drive lugs on the splined drive member 57. These lugs are illustrated as 58.

Impeller 6 can be easily removed and replaced simply by loosening and removing locknut 82 from the threaded end of stub shaft 80 and by removing the stub shaft 76 from end wall 22. Stub shaft 76 can be removed simply by unthreading shaft 77 from locknut 79 and then axially withdrawing stub shaft 76 through end wall 22 until it is disconnected from impeller 6. Then, by sliding the impeller 6 sufficiently far towards end wall 22 to clear the splined drive member 57, the impeller 6 is then freed from compartment 20 and may be removed therefrom. A new impeller 6 may be put in place using a reverse sequence of movements. Namely, new impeller 6 is first axially slid onto splined drive member 57 and locknut 82 tightened thereon. Stub shaft 76 is then slid inwardly through end wall 22 and after passing through locknut 79 is received in bore 70. When stub shaft 76 is tightened in locknut 80, replacement of impeller 6 will be completed. This allows easy removal and replacement of impeller 6 should the impeller be damaged.

Preferably, all the components of impeller 6 are integrally formed together. Specifically, it is preferred that impeller 6 be rotationally molded of a plastic material. The use of the strengthening surface 65, blade support members 66, and strengthening ribs 68 on each of the blades 60 is important. This provides each of the blades 60 with sufficient rigidity to allow the drive torque applied to the side wall 63 to be transmitted through the length of the impeller. This obviates the need for a through shaft and allows a completely open radial volume 61 to be used. Since a through shaft is no longer required in this construction of the impeller, removal and replacement of impeller 6 has been simplified. In addition, the lack of a through shaft along with the formation of impeller 6 as a one piece plastic unit decreases the cost and complexity of the impeller. This allows snowthrower 2 to be more inexpensively manufactured.

THE HANDLE

As shown in FIGS. 1, 6, and 7, the handle 10 is preferably made in two sections. Preferably, the handle 10 comprises a lower handle tube 84 and an upper handle tube 85. The lower end of the upper handle tube 85 receives the reduced diameter upper end of the lower handle tube 84 such that these ends of the handle tubes interfit together in a telescoping arrangement. A cylindrical sleeve 86 surrounds the junction of the two handle tubes 84 and 85. A number of bolts or other threaded securing members 87 pass through one side of sleeve 86, through the telescoped ends of handle tubes 84 and 84, and into the other side of sleeve 86 where they are received in nuts 88. When bolts 87 are tightened in nuts 88, they serve to rigidly secure handle tubes 84 and 85 together. This not only allows an elongated handle 10 to be made of a plurality of separate interconnected tubes 84 and 85, but it allows handle 10 to be disassembled during shipment and then assembled at the point of use of snowthrower 2. While the use of two interconnected handle tubes 84 and 85 is preferred, handle 10 could be formed from a single tube if so desired. However, in the latter construction, handle 10 cannot be disassembled for compact shipping as is the case when two handle tubes 84 and 85 are used.

THE SWITCH MEANS

Referring now particularly to FIGS. 2–4, the description of switch means 14 will be described. Control grip 12 is substantially hollow and defines a compartment 90 for receiving the switch means 14. An electrical conductor cord 91 runs into the control grip 12 which cord 91 includes an electrical plug 92. Plug 92 is suited to be inserted into any available electrical outlet (not shown) for actuating drive motor 8. An extension cord (not shown) may be provided with the unit so that plug 92 can be coupled to a remote electrical outlet. Alternatively, the cord 91 can be sufficiently long such that it can itself extend to such remote outlets. However, the use of an extension cord is preferred.

Switch means 14 includes an electrical switch 93 having a spring biased actuating plunger 94. Plunger 94 is inwardly movable to close switch 93. In the closed position of switch 93, electrical current is conducted from cord 91 to a conductor 95. Conductor 95 extends down through handle 10 to motor 8. Thus, in the closed condition of the switch 93, electric current is applied to the motor 8 to actuate the same. In the open position of the switch 93, corresponding to that position where plunger 94 is biased outwardly from the switch, the electric current flow is not established and motor 8 is not activated. Switch 93 is fixedly contained inside control grip 12 in any suitable manner.

An elongated switch bar 96 is pivotably located in the control grip 12 to cooperate with plunger 94 of switch 93 for actuation of the same. Specifically, switch bar 96 is pivotably mounted for movement between a first position in which it is spaced from plunger 94, as shown in phantom lines in FIG. 3, to a second position in which it engages plunger 94 to push it inwardly to close switch 93, as shown in solid lines in FIG. 3. The pivotal mounting of switch bar 96 may be accomplished in any suitable manner. One manner for accomplishing this is simply to form each end of the switch bar 96 with outwardly extending flanges 97. The flanges 97 extend inside of the compartment 90 of control grip 12 in such a manner that flanges 97 are engaged against the edges of the control grip 12 adjacent the opening in which switch bar 96 is contained. This prevents switch bar 96 from falling outside of the opening since the control grip 12 may be made in halves which are assembled after the switch bar is located in compartment 90. The front flange 97 of switch bar 96 acts as the pivot point for switch bar 96.

This invention also relates to a safety means for preventing inadvertent actuation of motor 8. This safety means comprises a lockout member 100 which is pivotably mounted on a shaft 101 inside the control grip. Lockout member 100 is in the form of a crankarm having a cylindrical hub 102 received on shaft 101, a first relatively long leg 103 extending from one side of hub 102, and a second leg 104 extending from the other side of hub 102. In addition, a lug 105 is affixed to hub 102 and extends down past hub 102 as shown in FIG. 4. A spring 106 having two outwardly extending legs 107 and 108 is located around shaft 101 beneath lockout member 100. One leg 107 bears against the lug 105 on lockout member 100. The other leg 107 of spring 106 bears against another lug 109 which is fixed in control grip 12 relative to lockout member 100. Spring 106 normally biases lockout member 100 to a first position in control grip 12.

Lockout member 100 is rotatable between first and second positions. In the first position of lockout member 100 (shown in FIG. 2), the outer end 110 of the first leg 103 is received on top of a step or lip 112 in switch bar 96. This prevents switch bar 96 from being moved inwardly to actuate switch 93. Furthermore, in this first position of lockout member 100, second leg 104 is in an interferring position with or aligned with a generally circular opening 114 in control grip 12.

A key member 116 is adapted to be inserted through opening 114. Key member 116 has a conically shaped outer end 118 which defines a cam. Inserting key member 116 through opening 114 causes outer end 118 to engage the second leg of lockout member 100 and rotate lockout member 100 to its second position against the biasing force of spring 106. In this second position of lockout member 100 (shown in FIG. 3), the outer end 110 of first leg 103 has been moved away from engagement with step 112. This releases switch bar 96 for inward movement when depressed to actuate switch 93. Key member 116 is prevented from inadvertently falling out of opening 114 by virtue of a hook 120 formed as part of a second leg 104. Hook 120 engages on a lip 122 at the termination of the conical outer end 118 of key member 116 to firmly retain key member 116 in place in control grip 12 keeping in mind the biasing force of spring 106 tends to return lockout member 100 to its first position. However, the locking action afforded by hook 120 and spring 106 is not sufficiently strong to prevent key member 116 from being manually withdrawn when desired.

In order for drive motor 8 to be actuated, key member 116 must always be inserted into control grip 12 before the switch bar 96 can be depressed. Thus, inadvertent or accidental operation of snowthrower 2 is prevented even when snowthrower 2 is plugged into a power source since an affirmative step must be taken by the operator before switch bar 96 is movable. Accordingly, snowthrower 2 according to this invention is safer to use than previously known devices since use of key member 116 is required to begin operation of drive motor 8. Children would not be able to accidentally start snowthrower 2 without key member 116. Even if such children had key member 116, they also might not be able to properly insert it through opening 114. Thus, snowblower 2 according to this invention has enhanced safety features.

OPERATION

To operate snowthrower 2 according to this invention, the electrical cord 91 is first plugged into a suitable electrical outlet or power source. Then, the key member 116 is inserted through opening 114 in control grip 12. Upon actuation of switch bar 96, drive motor 8 will be actuated to rotate impeller 6 generally in the direction of the arrow B. With impeller 6 rotating, the user then holds onto control grip 12 and handle 10 to position the impeller containing compartment 20 against the ground surface containing the snow which is to be cleared. Rotation of impeller 6 moves the snow through the housing and ejects it in the direction of the arrow A with sufficient force to throw the snow to a point distally located from the snowthrower.

Snowthrower 2 according to this invention is particularly advantageous. For one thing, it is relatively lightweight when compared to prior art snowthrowers. Thus, certain users are encouraged to use this snowthrower who would have been deterred by their complexity and difficulty in using larger snowthrowers. Moreover, because this is a mass-produced consumer type item, impeller 6 has been designed in a particularly simple and efficient manner obviating the use of a through shaft. This decreases the cost of manufacturing impeller 6 as well as making it more easily replaceable. In addition, the safety of snowthrower 2 is enhanced by the use of switch means 14 which prevents inadvertent actuation of drive motor 8. All these features are desirable additions to a snowthrower like that of the present invention.

Various modifications of this invention will be apparent to those skilled in the art. Thus, the scope of this invention is to be limited only by the appended claims.

What is claimed is:

1. An improved snowthrower of the type having a snow throwing impeller mounted in an impeller housing, wherein the impeller housing has end walls and an outlet through which the snow is thrown by the impeller, wherein the impeller is mounted between the end walls of the impeller housing for rotation about a substantially horizontal axis, wherein the impeller includes a plurality of impeller blades which are spaced apart from one another to establish an open volume therebetween, and wherein the improvement relates to the impeller and comprises:

an impeller having spaced apart side walls between which the blades extend, wherein the blades are sufficiently rigid to transmit a drive torque from one side wall to the other side wall, and wherein the open volume is radially inwardly of the blades and is completely open in that no mounting shaft extends through the impeller in a direction substantially parallel to the blades, whereby the blades themselves, rather than a mounting shaft, transmit a drive torque applied to one of the side walls through the impeller, wherein one of the end walls of the housing includes a stub shaft and the other end wall of the housing includes a means for driving the impeller, wherein the impeller driving means includes a drive member, and wherein the impeller includes a bore on one side wall for being loosely received on the stub shaft and a drive aperture on the other side wall which is configured to receive the drive member in a driving engagement, and wherein the stub shaft is removably contained in the end wall and the impeller has a length less than the distance between the drive member and the end wall which holds the stub shaft such that the impeller can be slid laterally off the drive member when the stub shaft is removed to allow removal of the impeller without disassembly of the impeller or the end walls of the housing.

2. An improved snowthrower as recited in claim 1, wherein the drive member is splined for driving the impeller and has a threaded outer end which extends inwardly through the side wall of the impeller, and further including a threaded securing member received on the threaded end of the splined drive member for bearing against the side wall to hold the impeller on the splined drive member when the other side wall of the impeller is received on the stub shaft.

3. An improved snowthrower of the type having a snow throwing impeller mounted in an impeller housing, wherein the impeller housing has end walls and an outlet through which the snow is thrown by the impeller, wherein the impeller is mounted between the end walls of the impeller housing for rotation about a substantially horizontal axis, wherein the impeller includes a plurality of impeller blades which are spaced apart from one another to establish an open volume therebetween, and wherein the improvement relates to the impeller and comprises:

an impeller having spaced apart side walls between which the blades extend, and wherein the blades are sufficiently rigid to transmit a drive torque from one side wall to the other side wall, and wherein the open volume is radially inwardly of the blades and is completely open in that no mounting shaft extends through the impeller in a direction substantially parallel to the blades, whereby the blades themselves, rather than a mounting shaft, transmit a drive torque applied to one of the side walls through the impeller, wherein the blades include a first working surface which contacts the moves the snow relative to the housing for throwing the snow through the housing outlet, and wherein each blade further includes a second strengthening surface oriented generally perpendicularly to the first working surface for stiffening the first working surface and defining a generally L-shaped blade.

4. An improved snowthrower as recited in claim 3, further including at least one stiffening rib extending between the first and second surfaces of each blade for further reinforcing the blade.

5. An improved snowthrower as recited in claim 4, further including at least one blade support member approximately parallel to and spaced between the side walls of the impeller, wherein the blade support member is fixedly secured to all of the blades for further reinforcing and supporting the blades in a rigid manner.

6. An improved snowthrower as recited in claim 5, wherein the blade support member comprises a solid disk which extends between and is secured to the blades.

7. An improved snowthrower as recited in claim 5, further including a plurality of substantially parallel and spaced apart blade support members located between the side walls of the impeller and secured to the blades for reinforcing the blades.

8. An improved snowthrower as recited in claims 1 or 5, wherein the side walls of the impeller, the blade and the blade support member are integrally molded in one piece from a plastic material.

* * * * *